United States Patent [19]

Tomita et al.

[11] Patent Number: 4,575,219

[45] Date of Patent: Mar. 11, 1986

[54] DRY PROCESS DEVELOPING APPARATUS HAVING DETACHABLE SCREENING MEMBER FOR DEVELOPING UNIT

[75] Inventors: Satoru Tomita, Kawasaki; Haruhiko Nagayama, Tokyo, both of Japan

[73] Assignee: Ricoh Company, Ltd., Tokyo, Japan

[21] Appl. No.: 579,330

[22] Filed: Feb. 13, 1984

[30] Foreign Application Priority Data

Feb. 21, 1983 [JP] Japan ..... 58-26371

[51] Int. Cl.[4] ..... G03G 15/09

[52] U.S. Cl. ..... 355/3 DD; 118/657; 118/658

[58] Field of Search ..... 355/3 DD, 15; 118/653, 118/657, 658

[56] References Cited

U.S. PATENT DOCUMENTS

| | | | |
|---|---|---|---|
| 3,380,355 | 4/1968 | Eichorn | 355/15 |
| 3,809,012 | 5/1974 | Delvecchio | 118/653 X |
| 3,863,603 | 2/1975 | Buckley et al. | 355/3 DD X |
| 4,040,386 | 8/1977 | Smith | 118/653 |
| 4,337,724 | 7/1982 | Hosono et al. | 355/3 DD X |

*Primary Examiner*—A. T. Grimley
*Assistant Examiner*—J. Pendegrass
*Attorney, Agent, or Firm*—David G. Alexander

[57] ABSTRACT

A dry process developing apparatus for a copier or like machine is constructed to prevent a toner from scattering inside the machine. The toner is transported to a surface of a photoconductive element via an opening which is formed through part of a casing adapted to store the toner. First and second screening means are detachably mounted on the casing and arranged to cover a front open portion between the surface of the photoconductive element and the casing of the developing apparatus as well as side open portions.

7 Claims, 16 Drawing Figures

DRY PROCESS DEVELOPING APPARATUS HAVING DETACHABLE SCREENING MEMBER FOR DEVELOPING UNIT

BACKGROUND OF THE INVENTION

The present invention relates to a developing apparatus for a copier, printer or like recording machine and, more particularly, to an improvement in a dry process developing apparatus which uses a dry developer for developing a latent image.

Various developing apparatuses have been proposed and put to practical use such as those of a magnet brush type, a cascade type, a fur brush type and a spray type. A magnet brush type developing apparatus, for example, usually includes a casing which is filled with a developer such as a toner and a developing sleeve which is rotatably disposed at the bottom of the casing. A plurality of magnets are accommodated in the developing sleeve so that the toner may be magnetically deposited on the surface of the sleeve and carried thereby toward a photoconductive element by the rotation of the sleeve. The toner is transferred from the developing sleeve to the photoconductive element to develop an electrostatic latent image on the photoconductive element.

In such a developing operation, the toner is transported at a rate which is three to seven times the feed rate of the photoconductive element so as to contact or impinge on the photoconductive element. The toner, therefore, is allowed to scatter in various directions inside a machine upon contact with the photoconductive element. The scattering toner tends to become deposited on chargers, an optical system and other various portions inside the machine, causing irregular charging and/or exposure. Such would degrade a reproduced image bringing about irregularity in image density, background density, etc.

Furthermore, streams of air are apt to entrain the toner as far as an electric power source section and mechanical sections such as drive linkages to invite electrical and mechanical malfunctions or troubles.

SUMMARY OF THE INVENTION

It is therefore an object of the present invention to provide a dry process developing apparatus which is furnished with an effective countermeasure against scattering of a toner, while allowing a minimum of obstruction to the operation or function of other structural elements.

It is another object of the present invention to provide a generally improved dry process developing apparatus.

A dry process developing apparatus which develops a latent image on a photoconductive element by using a dry developer of the present invention comprises a casing formed with an opening adjacent to a surface of the photoconductive element, said casing storing the developer therein, a developer transport member located in the vicinity of the opening of the casing for transporting the developer, and a screening member for preventing the developer transported by the developer transport means from scattering in the apparatus, the screening member covering a front open portion between the surface of the photoconductive element and the casing.

In accordance with the present invention, a dry process developing apparatus for a copier or like machine is constructed to prevent a toner from scattering inside the machine. The toner is transported to a surface of a photoconductive element via an opening which is formed through part of a casing adapted to store the toner. First and second screening means are detachably mounted on the casing and arranged to cover a front open portion between the surface of the photoconductive element and the casing of the developing apparatus as well as side open portions.

The above and other objects, features and advantages of the present invention will become more apparent from the following detailed description taken with the accompanying drawing.

DESCRIPTION OF THE PREFERRED EMBODIMENTS

While the dry process developing apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
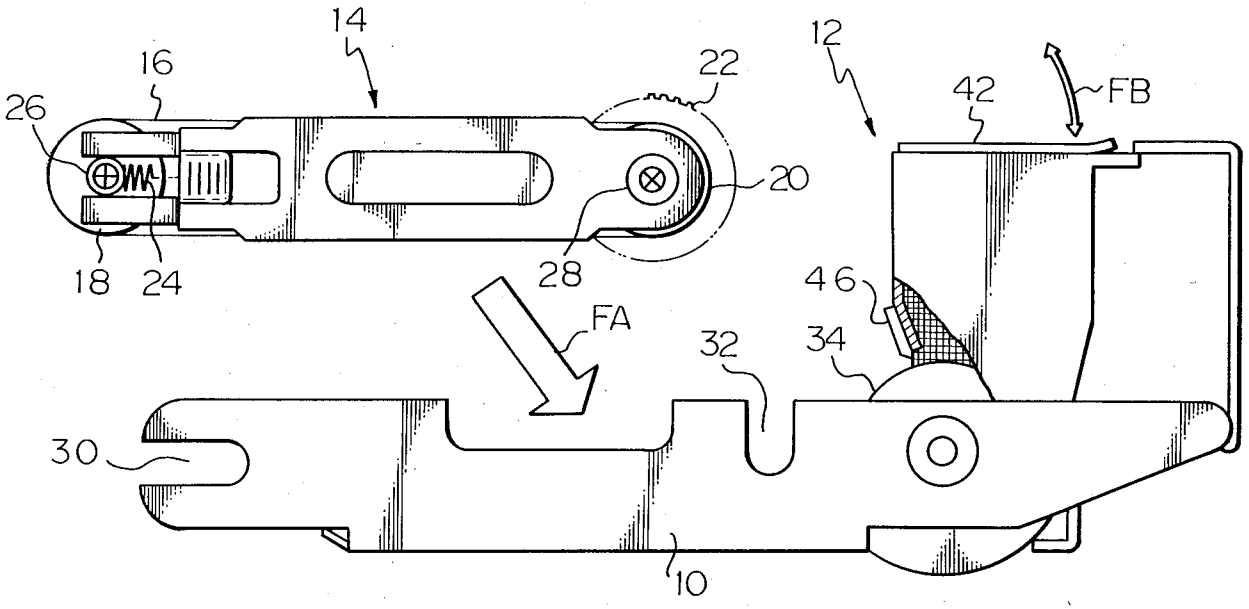
Fig. 1 PRIOR ART
FIG. 1 is a plan view showing an example of a magnetic brush type dry process developing apparatus.
Figure 2:
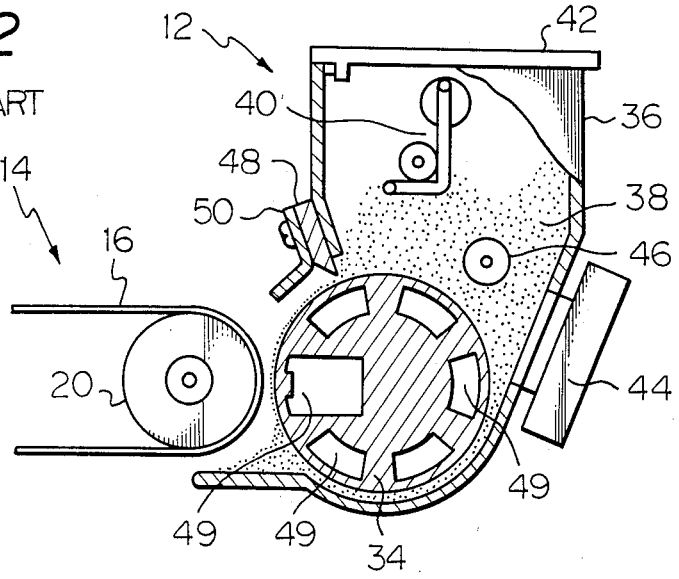
Fig. 2 PRIOR ART
FIG. 2 is a partly broken side elevation of an exemplary developing unit of the type using a magnet brush.
Figure 3:
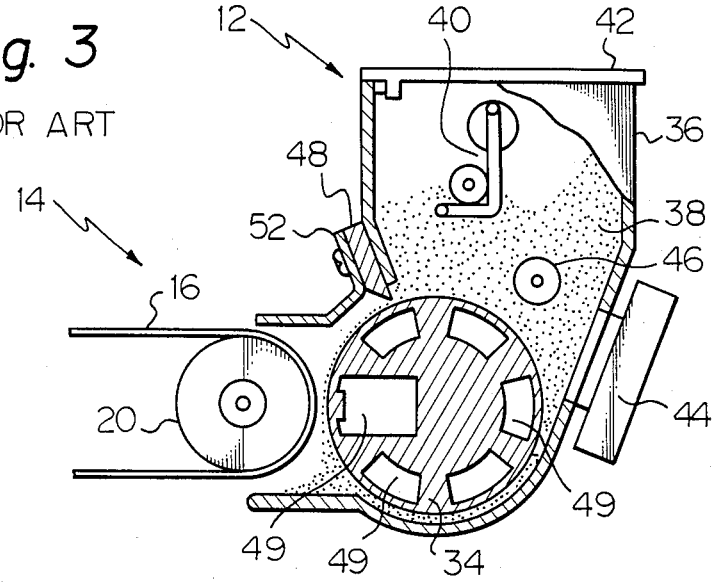
Fig. 3 PRIOR ART
FIG. 3 is a view similar to FIG. 2 but showing another example of the magnet brush type developing unit.

To facilitate understanding of the present invention, a reference will be made to a prior art developing apparatus of the type described, shown in FIGS. 1-3. As shown in FIG. 1, a developing unit 12 is located at the rightmost end of a cassette mount 10, which is adapted to support a photoconductor cassette as will be described. Examples of the developing unit 12 are shown in FIGS. 2 and 3. The photoconductor cassette, 14, carries therewith a pair of roller mechanisms 18 and 20 over which a photoconductive element 16 is passed. The photoconductive element 16 serves to carry a latent image thereon and may comprise a belt or a sheet. A drive gear 22 is coupled with the roller mechanism 20. The cassette 14 is put into the cassette mount 10 in a direction indicated by an arrow FA in the drawing, such that part of the surface of the photoconductive element 16 faces the developing unit 12. A spring mechanism 24 intervenes between the roller mechanism 18 and a framework of the cassette 14 to impart a suitable magnitude of tension to the photoconductive element 16. Bearings 26 and 28 mounted on the cassette 14 are respectively engaged in a positioning recess 30 and a regulating recess which are formed in the cassette mount 10, so that an adequate gap is defined between the photoconductor 16 and a sleeve 34. In such a position, a latent image is electrostatically formed on the surface of the photoconductor 16 by means (not shown), while the developing unit 12 develops the latent image by applying a developer to the latent image.

Practical examples of the developing unit 12 are shown in FIGS. 2 and 3. In each of FIGS. 2 and 3, a developing sleeve 34 is rotatably disposed in a bottom portion of a casing 36. Disposed above the developing sleeve 34 inside the casing 36 is an agitator 40 adapted to agitate the developer (referred to as "toner" hereinafter for simplicity) 38 which is stored in the casing 36. The toner 38 is introduced into the casing 36 via a portion of the developing unit 12 where an openable lid 42 is located (see FIG. 1). A sensor 44 is mounted on the casing 36 to sense a varying amount of the toner 38. Side walls of the casing 36 are supported by an elongate rod-like member 46. A doctor blade 48 is located adjacent to a position where the developing sleeve 34 is exposed to the outside of the casing 36, having an acutely angled edge thereof kept at a predetermined distance from the surface of the sleeve 34. A suitable number of magnets 49 are disposed in the developing sleeve 34 so that the toner 38 is deposited on the surface of the sleeve 34 by the magnetic force of the magnets 49. The amount of the toner 38 deposited on the sleeve 34 is regulated by the doctor blade 48 and, then, the regulated amount of toner is transferred to the photoconductor 16.

As previously discussed, during the operation described above, the toner 38 is transported at a three to seven times higher rate than the photoconductor 16 to contact or impinge on the photoconductor 16. Such a relative speed of the toner 38 and photoconductor 16 causes the toner 38 to scatter inside the machine upon contact with the photoconductor 16. The scattering toner 38 deposited on chargers, an optical system and other portions inside the machine would introduce irregularity in charging and exposure and, thereby, irregularity in image density and background density of a reproduced picture.

Additionally, the toner 38 tends to stick to an electric power source section and mechanical sections such as drive linkages due to the influence of streams of air, resulting in various troubles both electrically and mechanically.

One approach heretofore proposed to solve the problem discussed above is, as shown in FIG. 2, employing a screening member 50 which has a generally L-shaped cross-section and is fixed to the doctor blade 48 in such a manner as to cover the exposed portion of the developing sleeve 34. However, the screening member 50 is incapable of sufficiently preventing the toner 38 from scattering, although easy to mount and demount. In the other example shown in FIG. 3, a screening member 52 is extended toward the photoconductor 16 in order to desirably eliminate scattering of the toner 38. This is not fully acceptable, however, because the screening member 52 has to be attached and detached every time the cassette 14 is mounted and demounted.

Various embodiments of the dry process developing apparatus in accordance with the present invention will be described in detail with reference to FIGS. 4-16. Each of the embodiments is supposed to be used with the photoconductor cassette 14 and cassette mount 10 shown in FIG. 1.

Figure 4:
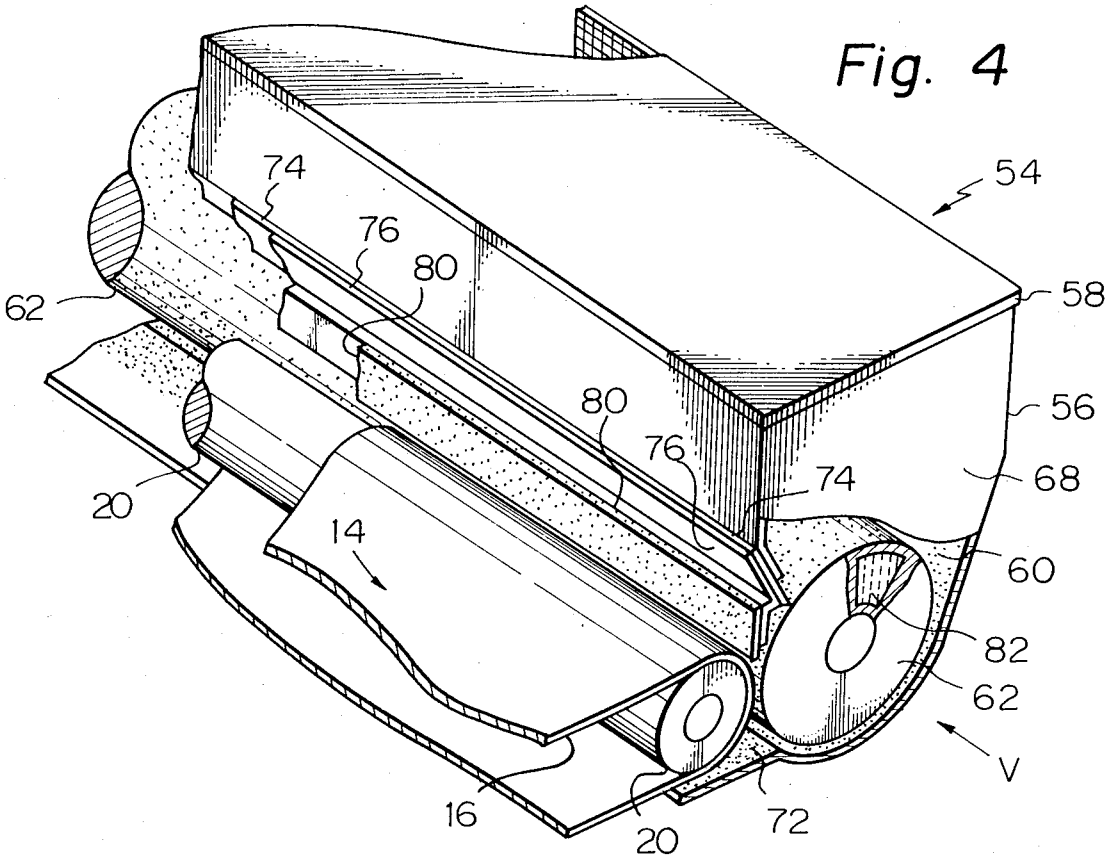
FIG. 4 is a broken perspective view of essential part of a dry process developing apparatus embodying the present invention.
Figure 5:
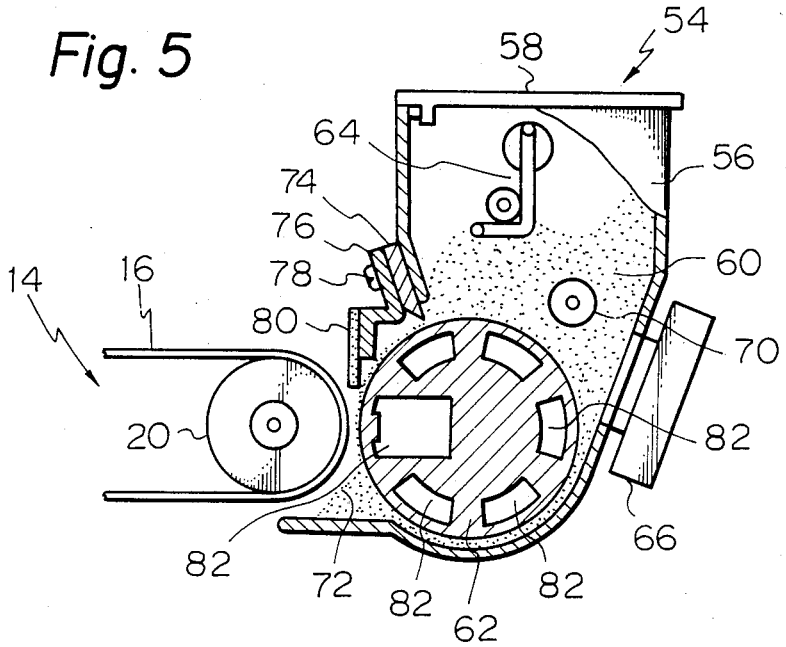
FIG. 5 is a side elevation of the apparatus of FIG. 4 as viewed in a direction indicated by an arrow V in FIG. 4.

Referring to FIGS. 4 and 5, a developing apparatus embodying the present invention comprises a developing unit 54. The developing unit 54 includes a casing 56 which is made up of a box-shaped upper portion and a funnel-shaped lower portion. A lid 58 openably closes the upper end of the casing 56 so that a toner 60 may be supplied by opening the lid 58. A developing sleeve 62 is positioned in the lower portion of the casing 56 at a suitable spacing from the inner wall of the latter. Disposed above the developing sleeve 62 inside the casing 56 is an agitator 64 adapted to agitate the toner 60. A sensor 66 is mounted in a suitable position on the outer periphery of the casing 56 to sense a varying amount of the toner 60. Side walls 68 of the casing 56 are supported by an elongate rod-like member 70.

The developing sleeve 62 is partly exposed to the outside through an opening 72 which is formed in a lower side surface of the casing 56. Among the edges of the casing 56 which define the opening 72, one which is close to the surface of the sleeve 62 carries a doctor blade 74 therewith. The acutely angled edge of the doctor blade 74 faces the surface of the sleeve 62 at a predetermined spacing therefrom. The doctor blade 74 extends in the lengthwise direction of the sleeve 62. A support member 76 is fastened to the doctor blade 74 by means of a screw mechanism 78 (not shown in FIG. 4).

The support member 76 extends in the lengthwise direction of the doctor blade 74 and has a cross-section which includes a portion parallel to the doctor blade 74, a portion extending from the parallel portion in a hook shape, and a portion extending vertically from the hook-shaped portion. A screening member 80 for preventing the toner 60 from scattering is securely mounted by suitable means on the outer surface of the perpendicularly extending portion of the support member 76, extending along the length of the support member 76. When the cassette 14 shown in FIG. 1 is placed in an operative position from the left as viewed in FIG. 5, the screening member 80 will be located in the gap which develops between the photoconductor 16 and the sleeve 62. The support member 76 is made of aluminum, brass or like non-magnetic metal or resin, while the toner is made of a sufficiently soft material such as rubber, sponge or brush, for example.

A suitable number of magnets 82 are mounted in the developing sleeve 62 to extend along the length of the sleeve 62 and arranged such that their polarities alternate with each other. The magnetic lines of force developed by the magnets 82 causes the toner 60 to form naps, or a brush, on the outer periphery of the sleeve 62.

In operation, a latent image is electrostatically formed on the photoconductor 16 by well known means. In accordance with the rotation of the roller mechanisms 18 and 20 (see FIG. 1), the photoconductor 16 with the latent image is moved to sequentially face the developing sleeve 62. Meanwhile, the sleeve 62 is driven to rotate in correspondence with the movement of the photoconductor 16 so that the toner 60 forms a brush on the sleeve 62. The height of the toner brush is adjusted by the doctor blade 74. With the rotation of the sleeve 62, the brush or naps of the toner 60 contacts or impinges on the photoconductor 16 to be thereby deposited on the surface of the photoconductor 16 in correspondence with the latent image. At this instant, although part of the toner 60 tends to scatter, the scattering is prevented by the support member 76 and screening member 80 and the toner 60 simply drops toward the bottom of the casing 56.

Another advantage attainable with the construction shown in FIGS. 4 and 5 is that the cassette 14 is readily movable into and out of the apparatus because the screening member 80 is positioned between the cassette 14 and the sleeve 62.

Figure 6:
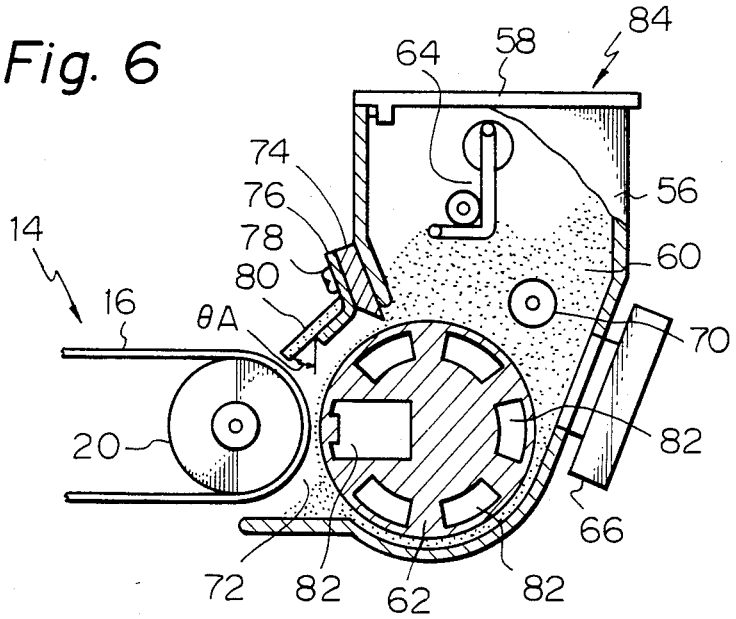
FIG. 6 is a partly broken side elevation of a second embodiment of the present invention.

Referring to FIG. 6, a second embodiment of the present invention is shown. In FIG. 6, the same or similar structural elements as those of the first embodiment are designated by like reference numerals and description thereof will be omitted for simplicity.

In FIG. 6, a developing unit, generally 84, includes the support member 76 which is securely connected to the doctor blade 74 by means of the screw mechanism 78. In this particular embodiment, the support member 76 has a leading end portion extending at an acute angle of $\theta$A to the vertical and, therefore, the screening member 80 is also angled $\theta$A to the vertical. The screening member 80 in FIG. 6, compared to the screening member 80 in FIGS. 4 and 5, is configured to cover part of the cassette 14. The toner scanning effect against scattering of the toner 60 becomes greater as the leading edge of the screening member 80 is brought closer to the photoconductor 16; a desirable spacing is less than 0.5 millimeters or even one which allows them to lightly touch each other.

In accordance with the embodiment shown in FIG. 6, the cassette 14 will be moved in the inclining direction of the screening member 80 when loaded into the apparatus. This insures smooth contact between the photoconductor 16 and the screening member 80, thereby eliminating damage to the photoconductor 16. Conversely, when the cassette 14 is unloaded from the apparatus, the cassette 14 will be moved in the opposite direction to the inclining direction of the screening member 80 and, therefore, the contact between the photoconductor 16 and the screening member 80 will not always be smooth and may even be unsmooth enough to damage the photoconductor 16. This is hardly objectionable in practice, however, because demounting the cassette 14 is usually performed at the time of replacement of the photoconductor 16.

Figure 7:
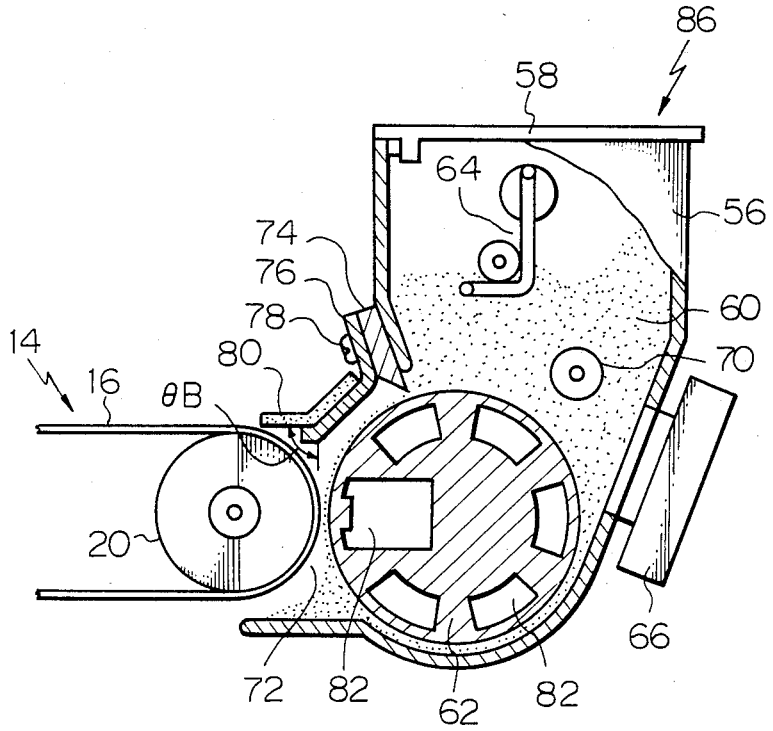
FIG. 7 is a partly broken side elevation of a third embodiment of the present invention.

A third embodiment of the present invention is shown in FIG. 7 which comprises a developing unit generally designated by the reference numeral 86. In this embodiment, the support member 76 fastened to the doctor blade 74 by the screw mechanism 78 has a leading edge portion which extends at an angle $\theta$B of substantially 90 degrees to the vertical and, therefore, the screening member 80 is also angled $\theta$B to the vertical. In this case, care should be taken in dimensioning the leading edge portion of the screening member 80, because making it too long toward the cassette 14 would damage the photoconductor 16 more than expected at the time of mounting and demounting the cassette 14.

While the screening member and the holder member have been shown and described in the first to third embodiments as being mounted on the doctor blade, such is only illustrative and they may be mounted on an upper portion of the casing, for example. Also, the screw mechanism for connecting the holder member to the doctor blade may be replaced by rivet means, adhesion or pressing means or fitting or suspending means.

Furthermore, in any of the embodiments described so far, the screening member and the support member may comprise an integral molding of rubber or plastic, instead of the shown and described separate members. Particularly, concerning the configuration and arrangement of the screening member, it is preferable to take into account the relationship between streams of air inside the equipment and scattering of the toner, moving speeds of the photoconductor and developing sleeve or their relative speed, etc.

While the description has concentrated to a cassette type photoconductor, a photoconductor generally has a limited service life and, therefore, mounted and demounted even if it is not of the cassette type. It follows that the present invention is effectively applicable even to recording machines which employ photoconductors in the form of drums. Further, the present invention is basically applicable not only to magnet brush type apparatuses but also to any other type of apparatuses.

As described above, the developing apparatus in accordance with any of the first to third embodiments described is successful to effectively restrain a toner from scattering to thereby insure recording of stable quality images over a long period of time. Additionally, the developing apparatus allows a photoconductor cassette to be mounted and demounted without any trouble. This is derived from the inherent construction wherein the screening member is positioned in the gap between the developing unit and the photoconductor cassette, and at least part of the screening member which neighbors the photoconductor is made of a soft material. Damage to the photoconductor in the event of mounting it will be eliminated if the screening member is inclined at an acute ange to the vertical.

Figure 8:
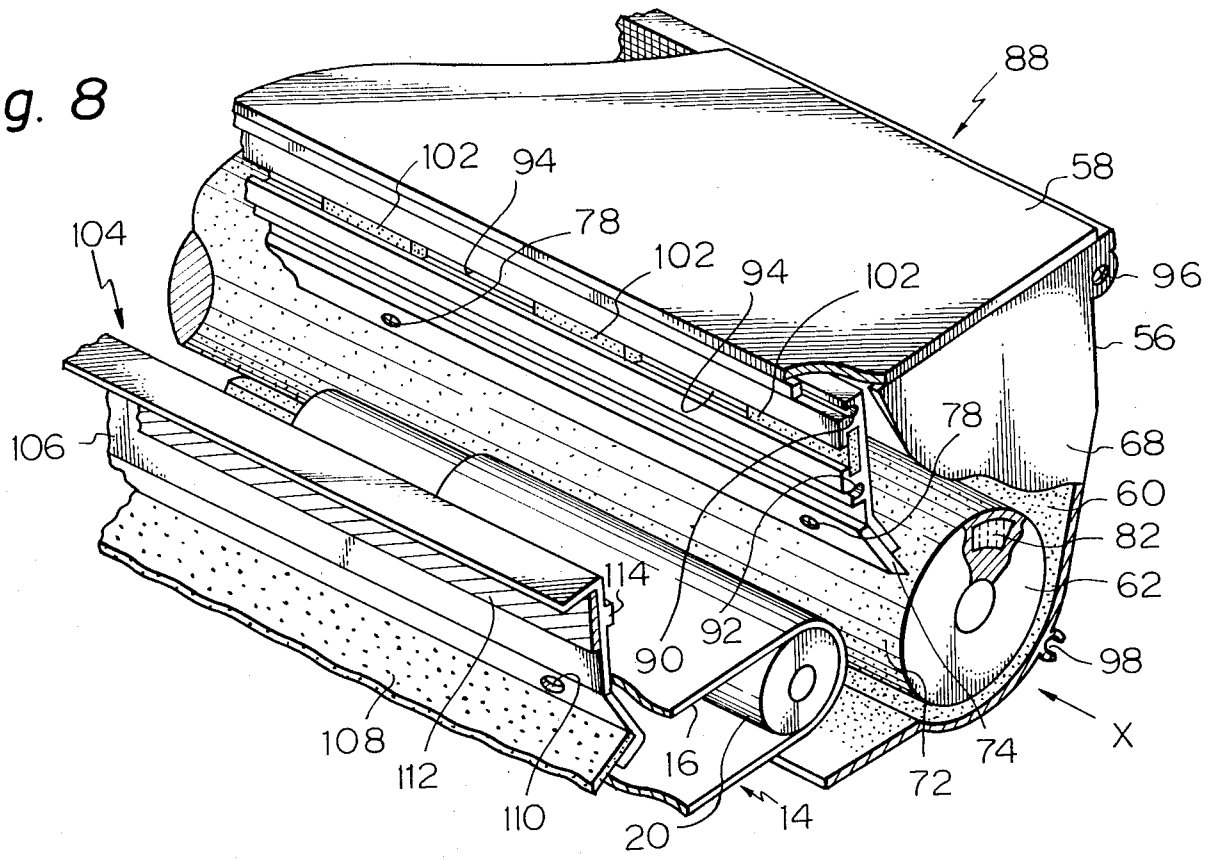
FIG. 8 is a fragmentary broken perspective view of a fourth embodiment of the present invention.
Figure 9:
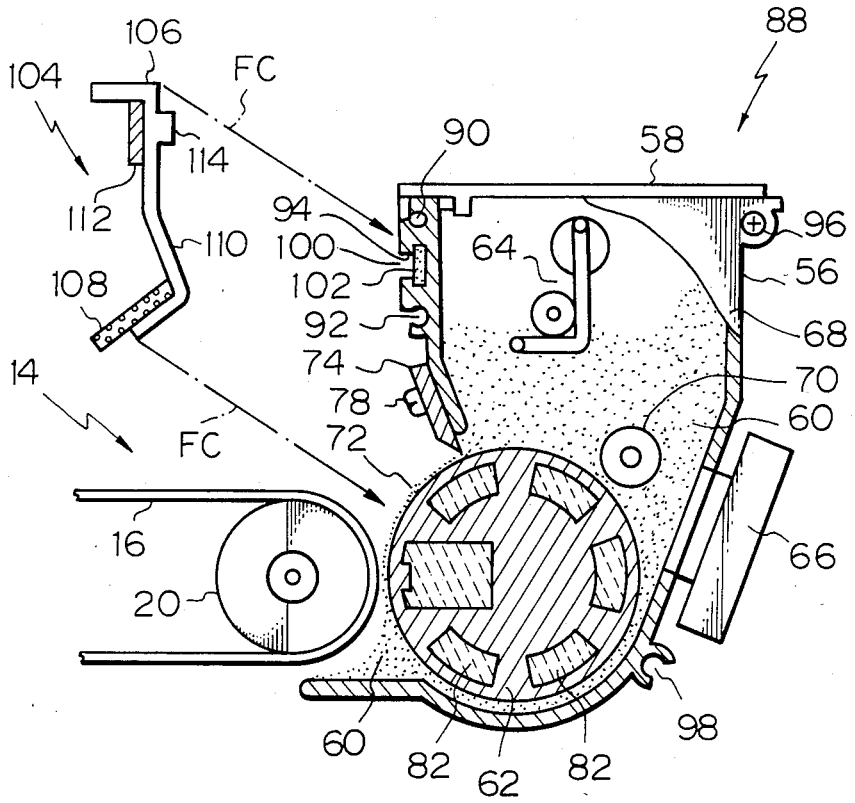
FIG. 9 is a side elevation as viewed in a direction indicated by an arrow X in FIG. 8.
Figure 10:
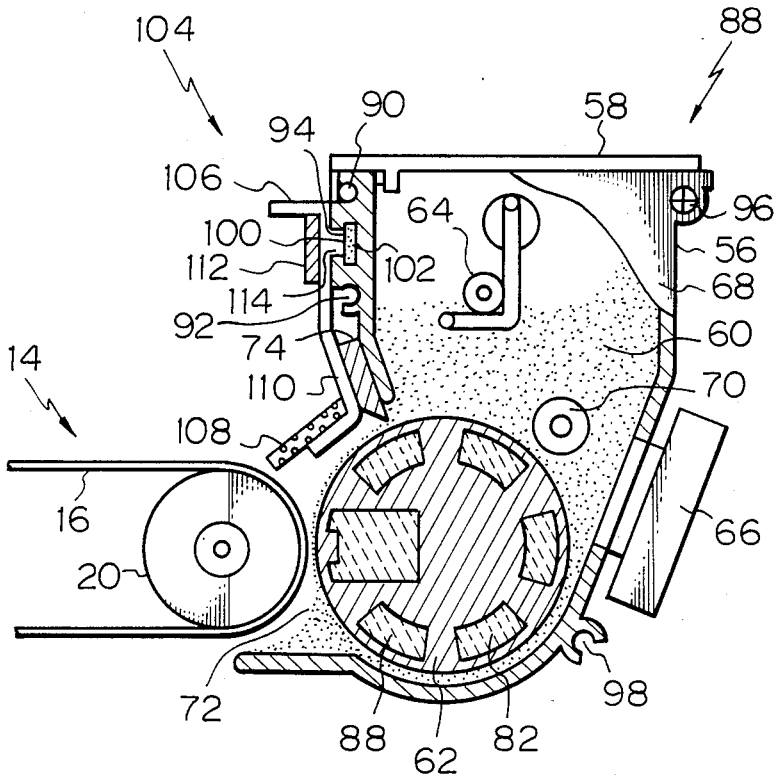
FIG. 10 is a side elevation of the construction shown in FIG. 9 with a screening member mounted in an operative position.

Referring to FIGS. 8–10, a fourth embodiment of the present invention is shown. In FIGS. 8–10, the same or similar structural elements as those of the first to third embodiments are designated by like reference numerals. As shown, a developing unit 88 includes first and second bores 90 and 92 each of which extends throughout a side portion of the casing 56 and in the side surface on which the doctor blade 74 is mounted. A channel 94 extends between the bores 90 and 92 in the casing wall. Nuts (not shown) are rigidly fit in opposite ends of each of the bores 90 and 92 to individually cooperate with bolts 96 to support the side walls 68. The same applies to a through bore 98. The channel 94 has an opening 100 directed to the left in FIG. 9. Magnetic members 102 are received in the channel 94 at suitable spacings along the length of the channel. The bores 90, 92 and 98 as well as the channel 94 may be formed integrally with the casing 56 by diecasting during production of the casing 56 or formed independently of the casing 56 to be connected to the casing 56 by adhesive, screws or like connecting means.

Description will be made of a screening member 104 which is associated with the developing unit 88.

The screening unit 104, adapted to prevent scattering of the toner, includes a support member 106 which is bent substantially perpendicularly at one end and bent generally in an S-shape at the other end. The S-bend of the support member 106 corresponds to that of the back of the doctor blade relative to the side surface of the casing 56. A soft member 108 extends from the leading edge of the S-bend portion of the support member 106 and along the length of the support member 106. Holes 110 for receiving bolt means 78 are formed through the S-bend portion of the support member 106. The substantially perpendicularly bent end, or hold portion, of the support member 106 allows one to hold it when mounting or demounting the support member 106. A magnet 112 extends lengthwise on a portion of the support member 106 just below the hold portion. A lengthwise projection 114 is formed on that surface of the support member 106 which opposes the magnet 112.

The support member 106 is made of, for example, non-magnetic metal such as aluminum or brass or resin, while the soft member 108 is made of a sufficiently soft material such as rubber, sponge or brush.

The operation of the fourth embodiment will be described hereinafter:

First, as shown in FIG. 1, the photoconductor cassette 14 is mounted on the developing unit 88 and, then, the screening member 104 is attached to the unit 88 in a direction indicated by an arrow FC in FIG. 9. In detail, as shown in FIG. 10, the projection 114 of the screening member 104 is inserted into the opening 100 which is contiguous with the channel 94 of the casing 56. In this position, the magnet 112 on the screening member 104 faces the magnet 102 disposed inside the channel 94 so that the screening member 104 is magnetically attached to the casing 56.

As shown in FIG. 8, before the screening member 104 is mounted to the casing 56, a substantial clearance exists between the opening 72 of the casing 56 and the photoconductor 16. However, when the screening member is mounted to the casing 56, it closes almost all the clearance. That is, the leading edge of the soft member 108 of the screening member 104 neighbors or lightly touches the surface of the photoconductor 16.

When it is desired to replace the cassette 14 with new one, the procedure described above will be performed in the opposite order. Namely, the screening member 104 is removed from the position shown in FIG. 10, the cassette 14 is replaced, and then the screening member 104 is again attached to the casing 56.

If a new cassette 14 is put into the apparatus with the screening member 104 mounted on the casing 56, the surface of the photoconductor 16 will touch the screening member 104. However, because the leading edge of the screening member 104 is formed by the soft material 108, damage to the photoconductor 16 is prevented. In more detail, when the cassette 14 is moved toward its operative position, it moves in the inclining direction of the soft member 108 so that the contact between the photoconductor 16 and the soft member 108 is smooth enough to avoid damage to the photoconductor 16.

Meanwhile, when the cassette 14 is demounted with the screening member 104 kept on the casing 56, if the attractive force exerted by the magnet 112 is relatively weak, the screening member 104 will also be removed due to the movement of the cassette 14 allowing the soft member 108 only to smoothly contact the photoconductor 16. If the attractive force of the magnet 112 is relatively strong, the cassette 14 will be moved in the opposite direction to the inclination of the soft member 108. Therefore, the contact between the photoconductor 16 and the soft member 108 is not always smooth and apt to damage the photoconductor. Again, this is hardly objectionable because it is usually at the time of replacement that the cassette 14 has to be removed.

As in the preceding embodiments, the screening member 108 offers a greater anti-scattering effect as its leading edge is brought closer to the photoconductor 16. A desirable spacing between them is less than 0.5 millimeters or even one which keeps them in slight contact.

Additionally, even though the toner may be scattered in the machine, it becomes partly deposited on the magnet 112 of the screening member 104. This will add to the anti-scattering effect attainable with the screening member 104.

Figure 11:
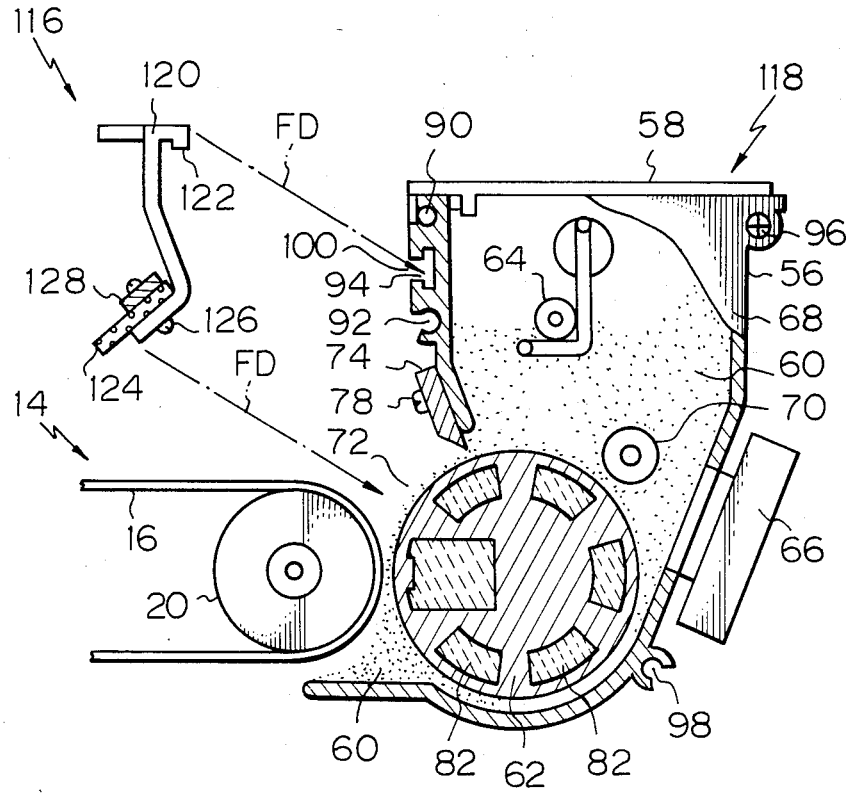
FIG. 11 is a side elevation of a fifth embodiment of the present invention.
Figure 12:
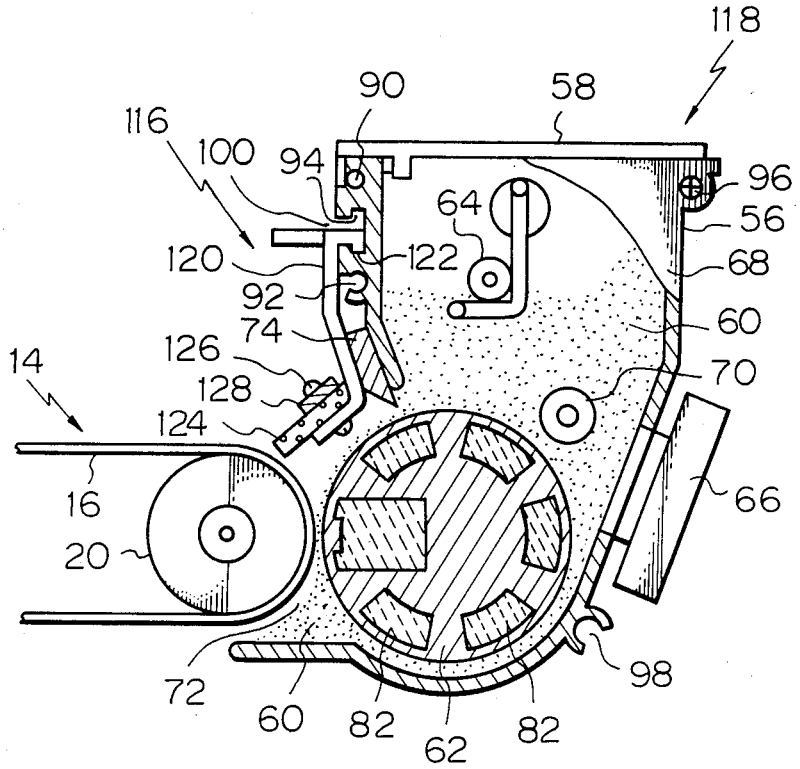
FIG. 12 is a side elevation of the construction shown in FIG. 11 with a screening member mounted in an operative position.
Figure 13:
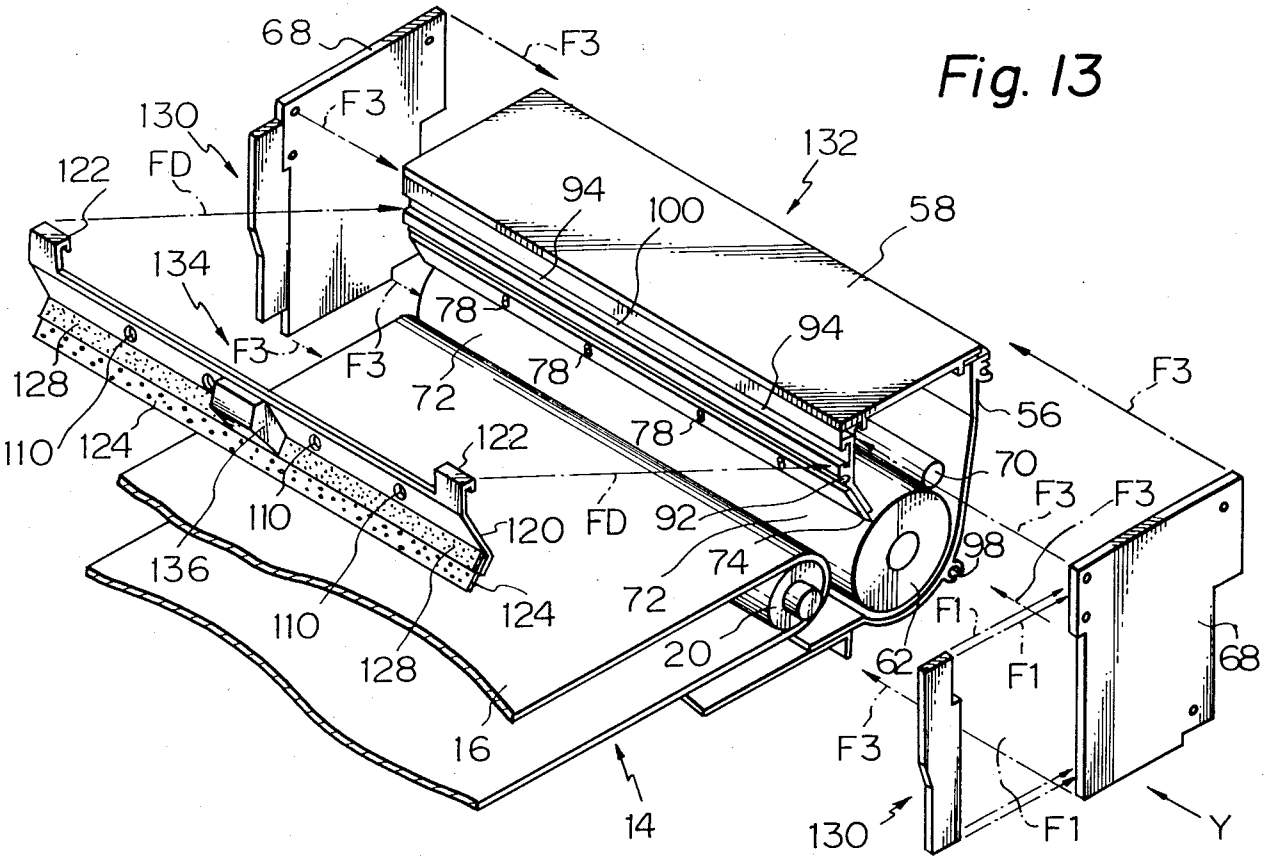
FIG. 13 is an exploded perspective view of a sixth embodiment of the present invention.
Figure 14:
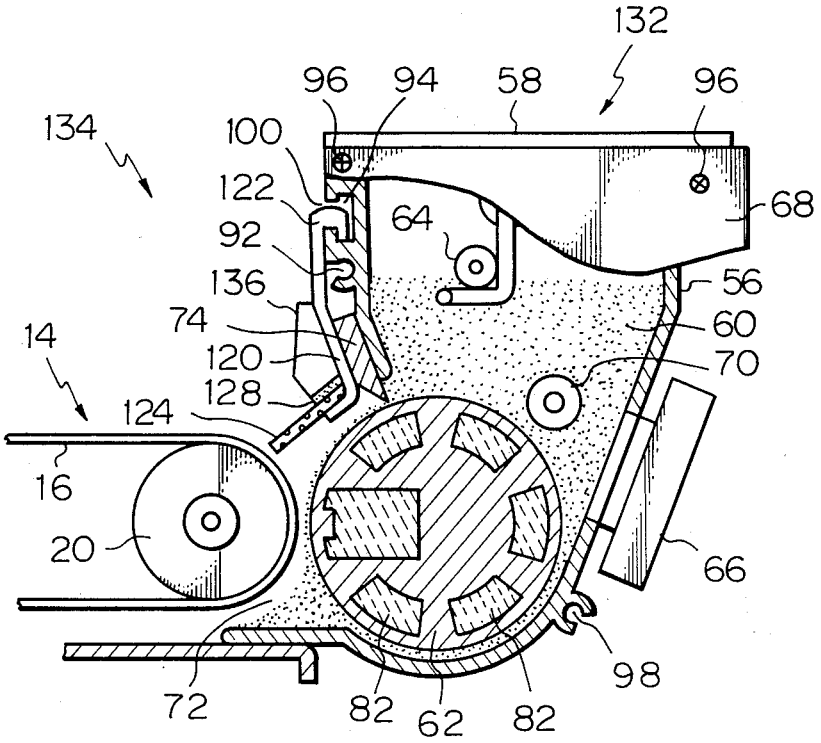
FIG. 14 is a side elevation as viewed in a direction indicated by an arrow Y in FIG. 13.

Referring to FIGS. 11 and 12, a fifth embodiment of the present invention will be described. In these drawing, the same or similar structural elements as those of the fourth embodiment are designated by the same reference numerals and description thereof will be omitted for simplicity.

In FIG. 11 which corresponds to FIG. 9, a screening member 116 is shown in a position separated from the casing 56. The position of the screening member 116 mounted on the casing 56 is shown in FIG. 12. The developing unit 118 in this particular embodiment differs from the developing unit 88 in the fourth embodiment in that it lacks the magnetic member 102. As shown, the screening member 116 is formed with a hook portion 122 adjacent to a hold portion of a support member 120. A soft member 124 extends along the length of a portion of the support member 120 which is bent generally in an S-shape, while protruding from the leading edge of the S-bend. A magnetic member 128 is fastened by a screw mechanism 126 to that surface of the S-bend of the support member 120 which faces the hold portion.

The screening member 116 is loaded in the casing 56 as indicated by an arrow FD in FIG. 11. In detail, the hook portion 122 of the screening member 116 is coupled in the opening 100 of the casing 56 and retained by the channel 94. On the other hand, the magnetic member 128 on the screening member 116 is brought close to the magnets 82 in the sleeve 62 to be subjected to their magnetic force. As a result, the magnetic member 128 is attracted by the magnets 82 whereby the screening member 116 is securely kept in the position shown in FIG. 12.

The present invention is not limited to the above-described fourth and fifth embodiments. For example, in the fourth embodiment, the magnet 112 and the magnetic member 102 may replace each other in position. Further, the support member 114 or 112 may be made of a magnetic material. That is, to which sides the magnet and the magnetic member should be placed is open to choice so long as the screening member can be desirably held on the developing unit by the magnetic force. It is necessary, however, to arrange, configure and construct the magnet and the magnetic member in such a manner as to eliminate adverse influence of the magnetic force on the toner, particularly magnetic toner, that is, on the development of a latent image. For example, consideration has to be given such that the toner 60 deposited on the sleeve 62 is prevented from forming a bridge at the position of the screening member 104 or 116.

If desired, clicking or friction may be employed in constructing the mechanism for attaching and detaching the screening member to the casing. The magnetic coupling means may utilize a repulsive force instead of the attractive force.

As described above, the fourth and fifth embodiments of the present invention effectively eliminate scattering of a toner to insure desirable operation of the machine over a long time. This is because a screening member is detachably mounted on a developing unit in such a manner as to cover exposed portions of the developing unit and photoconductive element. Where magnetic means is used for a support mechanism for the screening member, it will facilitate replacement of the photoconductor or the latent image carrier while promoting the ease of handling such as for cleaning.

Referring to FIGS. 13–16, a sixth embodiment of the present invention is shown. In these darwing, the same or similar structural elements as those of the fifth embodiment are designated by like reference numerals.

The embodiment shown in FIGS. 13–16 is distinguishable from the preceding embodiments, particularly one shown in FIGS. 11 and 12, by second screening members which are employed in addition to the screening member carried by the doctor blade or the like to cover the gap between the developing unit and the photoconductor. As shown in FIGS. 13–16, the second screening members, 130, are adapted to stop part of the toner which tends to scatter from the opposite side surfaces, that is, the lower right side and upper left side as viewed in FIG. 13. The screening members 130 form extensions of the opposite side walls 68 of the developing unit 132 which individually extend out toward the cassette 14. That is, the screening members 130 are bonded or otherwise connected to the side walls 68 in a direction indicated by an arrow F1 in FIG. 13. The side walls 68 and the screening members 130 are shown in their connected state in an upper left portion of FIG. 13.

In more detail, the second screening members 130 are connected to the casing 56 together with the side walls 68 when the side walls 68 are connected to the casing 56. The screening members 130 are respectively connected to the side walls 68 as indicated by an arrow F1, while the side walls 68 are connected to the casing 56 as indicated by an arrow F3. Each of the second screening member 130 substantially covers a clearance which is left in a side surface of the casing 56. While the cassette 14 is mounted and demounted in the condition described above, the screening members 130 are prevented from damaging the photoconductor 16 despite the movement of the cassette 14 because it is made of a flexible material.

Figure 15:
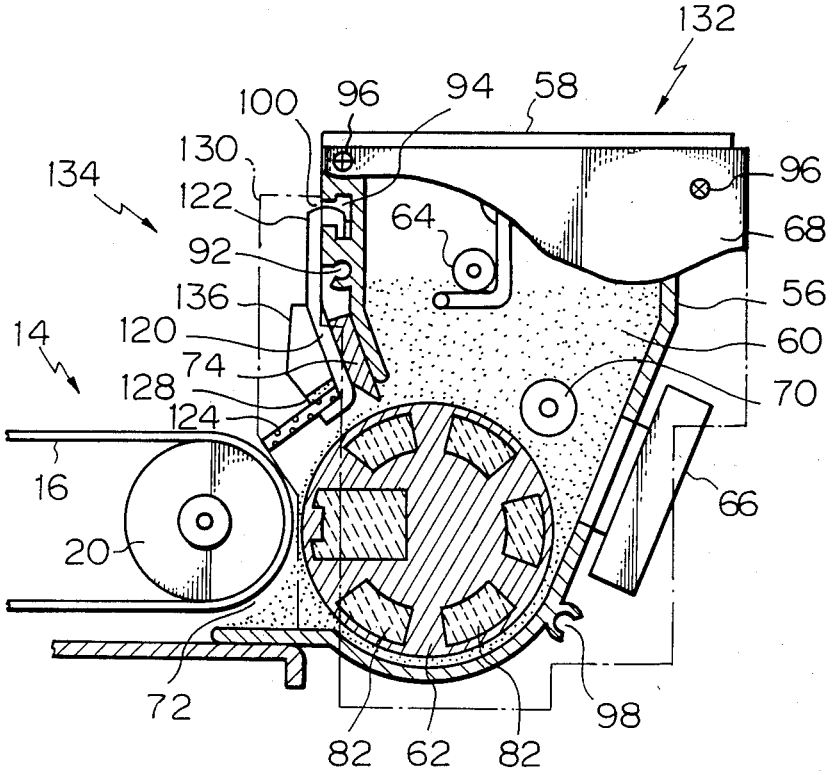
FIG. 15 is a side elevation of the construction shown in FIGS. 13 and 14 with second screening members mounted and seen through some structural elements.
Figure 16:
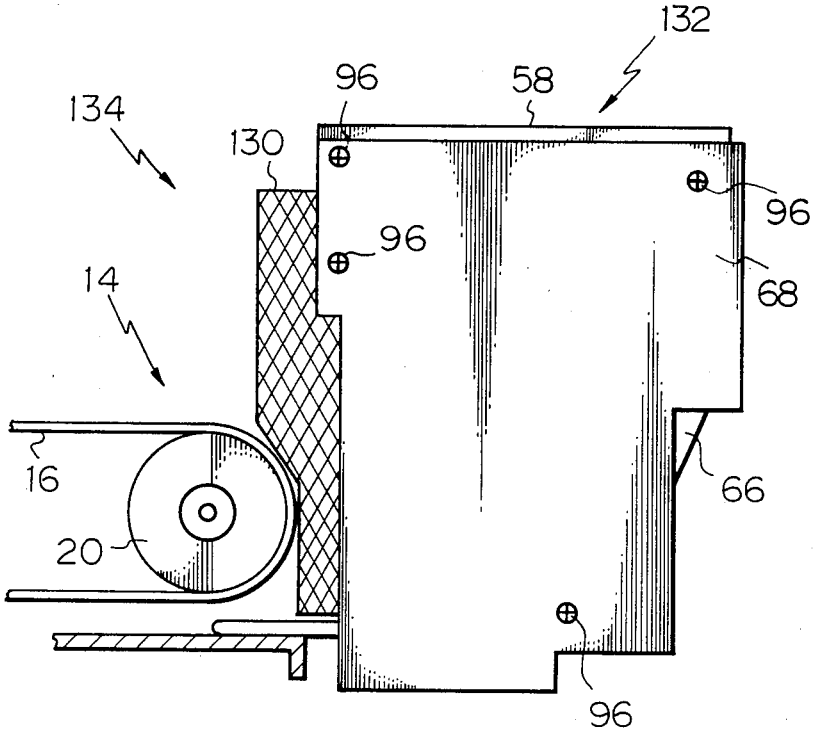
FIG. 16 is a side elevation of the construction shown in FIG. 15 with a first screening member and the second screening members mounted.

In FIGS. 15 and 16, the apparatus is shown with a first screening member 134 and the second screening members 130 individually mounted on the casing 56. Among these drawing, FIG. 15 is a view seen through the side wall 68 and screening member 130. If desired, only one of the second screening members 130 may be used for closing either one of the opposite sides of the casing 56.

In this particular embodiment, a hold member 136 protrudes from a substantially intermediate portion between opposite ends of the screening member 134 in contact with the support member 120 and magnetic material 128. The hold member 136 is accessible for attaching and detaching the screening member 134 to and from the developing unit 132. To more facilitate handling of the screening member 134, the hold member 136 may be made of an elastic material such as rubber which is deformable when held by fingers. The magnetic member 128, hold member 136 and the like may be mounted by means of adhesive, instead of caulking or like mechanical means. Adhesion will allow all the structural elements to be mounted evenly and simplify the production steps.

In the manner described, the sixth embodiment of the present invention prevents scattering of a toner without obstructing loading and unloading of a photoconductor cassette, thereby insuring the function of the machine for a long time. This advantage is attainable with the second screening member which covers clearances at side portions of a developing unit, the front clearance of which is covered by the first screening member.

Various modifications will become possible for those skilled in the art after receiving the teachings of the present disclosure without departing from the scope thereof.

What is claimed is:

1. A dry process developing apparatus which develops a latent image on a photoconductive element by using a dry developer, comprising:

a casing formed with an opening adjacent to a surface of the photoconductive element, said casing storing the developer therein;

developer transport means located in the vicinity of said opening of the casing for transporting the developer; and screening means for preventing the developer transported by said developer transport means from scattering in the apparatus, said screening means covering a front open portion between the surface of the photoconductive element and the casing;

the developer transport means comprising a developing sleeve in which a plurality of magnets are accommodated;

the screening means comprising a plate-like member supported by the casing and having a width which substantially covers said front open portion between the surface of the photoconductive element and the casing and a length which is substantially equal to a lengthwise dimension of the developing sleeve;

the screening means further comprising a magnetic member for magnetically coupling with the magnets in the developing sleeve to mount the screening means to the casing.

2. A dry process developing apparatus as claimed in claim 1, in which the developer comprises a toner.

3. A dry process developing apparatus as claimed in claim 1, in which the screening means is detachably mounted on the casing.

4. A dry process developing apparatus as claimed in claim 1, in which the plate-like member extends vertically in said front open portion between the surface of the photoconductive element and the casing.

5. A dry process developing apparatus as claimed in claim 1, in which the plate-like member extends at an acute inclination to the vertical in said front open portion between the surface of the photoconductive element and the casing.

6. A dry process developing apparatus as claimed in claim 1, further comprising second screening means for covering a side open portion between the surface of the photoconductive element and the casing.

7. A dry process developing apparatus as claimed in claim 6, in which the casing comprises a pair of side walls, the second screening means comprising a plate-like member which is connected to at least one of said side walls.

* * * * *